US012130108B2

(12) United States Patent
Kennedy

(10) Patent No.: US 12,130,108 B2
(45) Date of Patent: Oct. 29, 2024

(54) SYSTEM FOR A MULTI-CALIBER SELF-LOADING ACTION ASSEMBLY

(71) Applicant: Jordan Kristomas Kennedy, Chandler, AZ (US)

(72) Inventor: Jordan Kristomas Kennedy, Chandler, AZ (US)

( * ) Notice: Subject to any disclaimer, the term of this patent is extended or adjusted under 35 U.S.C. 154(b) by 0 days.

(21) Appl. No.: 18/070,974

(22) Filed: Nov. 29, 2022

(65) Prior Publication Data

US 2024/0077264 A1 Mar. 7, 2024

Related U.S. Application Data

(62) Division of application No. 17/214,889, filed on Mar. 28, 2021, now Pat. No. 11,644,256.

(51) Int. Cl.

| | |
|---|---|
| ***F41A 5/28*** | (2006.01) |
| ***F41A 3/16*** | (2006.01) |
| ***F41A 21/10*** | (2006.01) |
| ***F41A 21/12*** | (2006.01) |

(52) U.S. Cl.
CPC *F41A 5/28* (2013.01); *F41A 3/16* (2013.01); *F41A 21/10* (2013.01); *F41A 21/12* (2013.01)

(58) Field of Classification Search
None
See application file for complete search history.

(56) References Cited

U.S. PATENT DOCUMENTS

| | | | | | |
|---|---|---|---|---|---|
| 1,430,661 | A | * | 10/1922 | Lewis | F41A 13/02 89/193 |
| 2,393,627 | A | * | 1/1946 | Garand | F41A 5/26 89/193 |
| 2,484,694 | A | * | 10/1949 | Dicke | F41A 3/18 42/16 |
| 2,554,618 | A | * | 5/1951 | Dixon | F41A 5/22 89/193 |
| 2,645,873 | A | * | 7/1953 | Crittendon | F41A 3/40 42/21 |
| 2,648,153 | A | * | 8/1953 | Dicke | F41C 7/06 42/16 |
| 2,800,059 | A | * | 7/1957 | Miller | F41A 5/26 89/193 |
| 2,865,256 | A | | 12/1958 | Marsh | |

(Continued)

OTHER PUBLICATIONS

Heckler & Koch Defense XM8 Lightweight Modular Weapon System Pamphlet Current Website is https://hk-usa.com/.

*Primary Examiner* — Derrick R Morgan
(74) *Attorney, Agent, or Firm* — Lisa Foundation Patent; Qiguang Pan; Ben Alto

(57) ABSTRACT

System for a multi-caliber self-loading action. Specifically, the system is comprised of a multi-position locking assembly and a self-regulating gas assembly. The multiposition locking assembly is comprised of a bolt carrier, a spring, a bolt, a lock, and a cam assembly. The cam assembly will interface between the bolt carrier and the bolt to rotate the bolt through the bolt carrier. The lock will interface with the bolt, to lock the bolt in at least one locked position based on the caliber of the round inserted. The self-regulating gas assembly directs gas from the gas regulation to at least one piston cup, which will then cause the piston to act on the multi-position locking assembly.

20 Claims, 6 Drawing Sheets

(56) References Cited

U.S. PATENT DOCUMENTS 2,941,449 A * 6/1960 Reed ..... F41A 3/26 89/185
3,213,558 A * 10/1965 Asker ..... F41A 3/46 42/17
3,333,509 A * 8/1967 Muhlemann ..... F41A 5/28 89/193
3,630,118 A * 12/1971 Stoner ..... F41A 3/26 89/13.05
3,641,692 A * 2/1972 Wells ..... F41A 5/24 89/185
3,675,534 A * 7/1972 Beretta ..... F41A 3/72 89/185
4,022,105 A * 5/1977 White ..... F41A 19/31 89/181
4,244,273 A * 1/1981 Langendorfer, Jr. ..... F41A 5/18 89/193
4,389,919 A * 6/1983 Kast ..... F41A 19/02 89/185
4,579,034 A * 4/1986 Holloway ..... F41A 3/26 D22/103
4,635,530 A * 1/1987 Weldle ..... F41A 3/26 89/193
5,886,281 A * 3/1999 Kirstein ..... F41A 5/18 89/187.01
5,900,577 A * 5/1999 Robinson ..... F41A 11/02 89/191.01
6,901,689 B1 6/2005 Bergstrom
7,596,900 B2 10/2009 Robinson et al.
8,596,185 B1 12/2013 Soong et al.
8,667,882 B1 * 3/2014 Larson ..... F41A 35/06 89/142
8,806,789 B2 * 8/2014 Devine ..... F41A 11/00 42/16
8,807,010 B2 * 8/2014 Bubits ..... F41A 21/488 89/187.01
8,813,632 B2 * 8/2014 Adams ..... F41A 5/28 89/193
9,291,415 B1 3/2016 Beaty
9,816,769 B1 * 11/2017 Brown ..... F41A 5/28
9,879,931 B2 1/2018 Patel
10,048,029 B2 8/2018 Larson, Jr.
10,107,577 B2 * 10/2018 Kuhnle ..... F41A 3/26
10,386,145 B2 8/2019 Golan
10,458,732 B2 10/2019 Neitzling
11,346,627 B1 * 5/2022 DeMonico ..... F41A 3/66
11,519,681 B2 * 12/2022 Kennedy ..... F41A 5/26
2002/0073592 A1 * 6/2002 Murello ..... F41A 3/26 42/25
2005/0066564 A1 * 3/2005 Keeney ..... F41A 3/36 42/16
2005/0217473 A1 * 10/2005 Murello ..... F41A 5/24 89/187.01
2009/0031605 A1 2/2009 Robinson
2010/0000400 A1 * 1/2010 Brown ..... F41G 1/02 42/111
2010/0218671 A1 * 9/2010 Mayberry ..... F41A 5/28 89/192
2011/0023699 A1 * 2/2011 Barrett ..... F41A 5/28 89/193
2011/0179945 A1 * 7/2011 Clark ..... F41A 5/18 89/193
2011/0185886 A1 * 8/2011 Boutin, Jr. ..... F41A 5/24 89/191.01
2013/0025445 A1 * 1/2013 Windauer ..... F41A 5/28 89/193
2013/0269510 A1 * 10/2013 Sullivan ..... F41A 5/28 89/193
2014/0076144 A1 * 3/2014 Gomez ..... F41A 15/12 42/25
2014/0224114 A1 * 8/2014 Faxon ..... F41A 5/28 89/193
2015/0090109 A1 * 4/2015 Parsadayan ..... F41A 5/26 89/191.01
2015/0226502 A1 8/2015 Beaty
2015/0241149 A1 8/2015 McMillen, IV
2015/0260470 A1 * 9/2015 Foster ..... F41A 5/18 89/193
2015/0292825 A1 * 10/2015 Cassels ..... F41A 5/28 89/193
2016/0178299 A1 * 6/2016 Cassels ..... F41A 5/28 89/193
2017/0074609 A1 * 3/2017 Michlin ..... F41A 21/482
2017/0276445 A1 * 9/2017 Daley, Jr. ..... F41A 5/26
2018/0142972 A1 * 5/2018 Overstreet ..... F41A 19/30
2018/0156553 A1 * 6/2018 Rode ..... F41A 5/20
2018/0372435 A1 * 12/2018 Kramer ..... F41A 3/66
2019/0212083 A1 * 7/2019 Konev ..... F41C 27/22
2020/0025476 A1 * 1/2020 Aubin ..... F41A 5/26
2020/0232732 A1 * 7/2020 Noonan ..... F41A 11/00
2020/0240734 A1 * 7/2020 Serbu ..... F41A 5/18
2020/0333094 A1 * 10/2020 Overstreet ..... F41A 19/30
2021/0033362 A1 * 2/2021 Gregorich ..... F41A 5/18
2022/0333882 A1 * 10/2022 Bilgeri ..... F41A 15/10
2023/0125921 A1 * 4/2023 Keeney ..... F41A 5/28 89/193
2023/0228507 A1 * 7/2023 Fisher ..... F41A 5/26 89/193
2023/0366643 A1 * 11/2023 Geissele ..... F41A 5/20

* cited by examiner

SYSTEM FOR A MULTI-CALIBER SELF-LOADING ACTION ASSEMBLY

CROSS REFERENCE TO RELATED APPLICATIONS

This application is a divisional of U.S. patent application Ser. No. 17/214,889 filed Mar. 28, 2021, which claims priority to provisional U.S. Patent Application No. 63/121,159 filed Dec. 3, 2020, the contents of each are hereby incorporated by reference in their entirety.

STATEMENT REGARDING FEDERALLY SPONSORED RESEARCH

Not applicable.

NAMES OF PARTIES TO A JOINT RESEARCH AGREEMENT

Not applicable.

REFERENCE TO A SEQUENCE LISTING, TABLE, OR COMPUTER PROGRAM

Not applicable.

BACKGROUND

Different types of firearms can use a plurality of systems to eject the casing of a round and load it with a new round, ready for the user to fire the next round. One such system is the gas-operated reloading. One type of gas-operated system, direct impingement, uses the high-pressure gas that is generated from the round that is being fired, to push the bolt carrier backwards, and cause the casing to get ejected from the firearm and another round to be loaded. These systems need to be finely tuned to the caliber of each round that is being used. If there is too little gas, then the casing will not be ejected properly, and the firearm could jam. This would interrupt the user from firing another round without first ejecting and/or unjamming the firearm. If there is too much gas, then the walls of the casing could get pressed against the chamber and the friction could cause the casing to get stuck inside without ejecting. In addition, if there is even more gas than this, there could be enough to damage the components of the firearm itself. Current systems do not allow the usage of different sized calibers within a single firearm, in part, due to these restrictions. There are some firearms that work around this by replacing the different components of the firearm to enable it to fire different calibers. This process can potentially be time consuming and complex and may not be easy to do when the firearm needs to be used.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 9,879,931 discloses a multi-caliber machine gun system. The machine gun has different types of ammunition feed trays. When a certain type of ammunition feed tray is attached to the receiver assembly, the receiver assembly can be configured to fire that type of ammunition.

U.S. Pat. No. 10,386,145 discloses a double barrel firearm where each of the barrels can be adjusted. The angular orientation (e.g., azimuth and elevation) of each barrel can be adjusted utilizing two adjustment members mounted on to the barrels.

U.S. Pat. No. 10,458,732 discloses a bolt carrier extension system. The bolt carrier extension system allows the firearm to incorporate elongated upper and lower receivers, such that long-action or other center fire cartridges can be chambered within AR rifles.

U.S. Pat. No. 9,291,415 discloses an adjustable gas key. The gas key contains an inlet and outlet tube, as well as an inner volume. The user can adjust the inner volume with an adjustment device so that the amount of gas being vented, and the amount of gas sent back to the bolt carrier, is changed.

U.S. Pat. No. 8,596,185 discloses an adjustable gas block method and system for a gas operation firearm. The adjustable gas block system adjusts the size of the gas port, and thus the amount of gas, that enters into the gas tube. This is accomplished with a sliding adjustment plate, where the desired gas port is slid into place depending on the amount of gas desired.

U.S. Pat. No. 8,813,632 discloses an adjustable firearm gas block. This gas block contains a threaded bore with a set screw that enters into, and can restrict, the gas channel. As the set screw constricts the gas channel depending on how far the user screws the set screw in. There is also a second bore adjacent to the first threaded bore, which houses a detent plunger, which can lock the set screw into its desired, gas channel restricting, position.

U.S. Pat. No. 7,596,900 discloses a multi-caliber, ambidextrously controllable, firearm. There is an adjustable ejection system, which has a deflector and an ejection port. The deflector can be attached to one of at least two attachment positions, to adjust the size of the ejection port.

U.S. Pat. No. 2,865,256 discloses a compensating device for firearms. The compensating device takes the form of a system analogous to a double acting fluid motor to regulate the gas needed to cycle the firearm. This invention utilizes a single piston.

U.S. Pat. No. 6,901,689 discloses a pneumatic counter-recoil modulator. This is a gas cartridge system that is inserted into the firearm in order to help reduce recoil when the firearm is discharged. The cartridge is pre-loaded with gas from the manufacturer.

U.S. Pat. No. 10,048,029 discloses a firearm with a gas piston system. The system utilizes a gas regulator with a gas purge plug. Excess gas from the firearm's discharge is purged from the system once it reaches a certain threshold.

U.S. Pat. No. 5,900,577 discloses a modular, multi-caliber weapon system. The system can be reconfigured to fire a wide range of different calibers. The reconfiguration is accomplished by changing the following components: barrel, operating rod, recoil spring, and buffer; gas tube, bolt head, firing pin and extractor; and magazine well.

U.S. Pat. No. 8,806,789 discloses a multi-caliber interchangeable rifle bolt system. This firearm can be reconfigured to fire different calibers, by changing out the stock of the weapon. All of the elements necessary to reconfigure the weapon are stored in the stock of the weapon.

U.S. Pat. Pub. No. US 2015/0241149 discloses an adjustable gas key for an autoloading firearm. The gas key is coupled to a moving parts assembly, where it directs gas towards that assembly such that the firearm is cycled. The gas key has an adjustment control, which may be in some form of screw, which can affect the amount of gas directed. There can also be embodiments that allow a certain amount of gas to vent.

U.S. Pat Pub. No. US 2009/0031605 discloses a multi-caliber, ambidextrously controllable, firearm. This is a continuation to U.S. Pat. No. 7,596,900. There is an adjustable ejection system, which has a deflector and an ejection port. The deflector can be attached to one of at least two attachment positions, to adjust the size of the ejection port.

U.S. Pat. Pub. No. US 2015/0226502 discloses a bolt carrier with integral adjustable gas key. This is a continuation-in-part of U.S. Pat. No. 9,291,415. There is a bolt carrier with an integral adjustable gas key. The adjustable gas key includes a tube portion coupled to a base portion. An inlet passage extends through the tube portion and an outlet passage through the base portion. There is also an adjustment device, which adjusts the inner volume of the gas key. The adjustment of the inner volume adjusts the force of action of the bolt carrier.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicant(s) will amend the specification to expressly recite the essential material that is incorporated by reference as allowed by the applicable rules.

SUMMARY

The present invention provides among other things a multi-position locking assembly and a self-regulating gas assembly, which together comprise the multi-caliber self-loading action assembly.

A multi-position locking assembly is comprised of a bolt that interfaces with a chamber of a firearm; a bolt carrier that interfaces with the bolt; a spring that is configured to provide a closing force on the bolt; a lock that allows the bolt to lock in a plurality of locking positions; and a cam assembly that is situated between the bolt carrier and the bolt. When a round is inserted into the firearm, the cam assembly will rotate the bolt through the bolt carrier. The lock will interface with a lock receiver. The at least one locked position will be determined by a caliber of the round inserted into the firearm. The bolt will also have a chamber stem, which can fit inside the chamber of the firearm.

A self-regulating gas assembly is comprised of a gas block that will interface with at least one gas port on a barrel; at least one piston cup that will receive a gas from the gas block; and at least one piston that will interface with the at least one piston cup. When a discharge of the firearm occurs, the gas block will regulate an amount of gas. The gas block will direct the amount of gas to the at least one piston cup. A portion of the amount of gas will be vented. A remaining gas will be determined based on how much of the gas was vented from the firearm. The at least one piston will have a starting position, which will be determined by the caliber of the round inserted into the firearm. The at least one piston cup will act on the at least one piston through the remaining gas.

A multi-caliber self-loading action assembly that is made up of the multi-position locking assembly and the self-regulating gas assembly. The at least one piston will act on the multi-position locking assembly with a force received from the remaining gas. The multi-position locking assembly will be pushed away from the chamber and a casing of the round is ejected from the firearm. The multi-position locking assembly loads a new round into the firearm after the casing of the round is ejected.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographers, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

For the purposes of this invention, the term caliber references the specific geometry of a round.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . "or "step for performing the function of . . . ," if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1A:
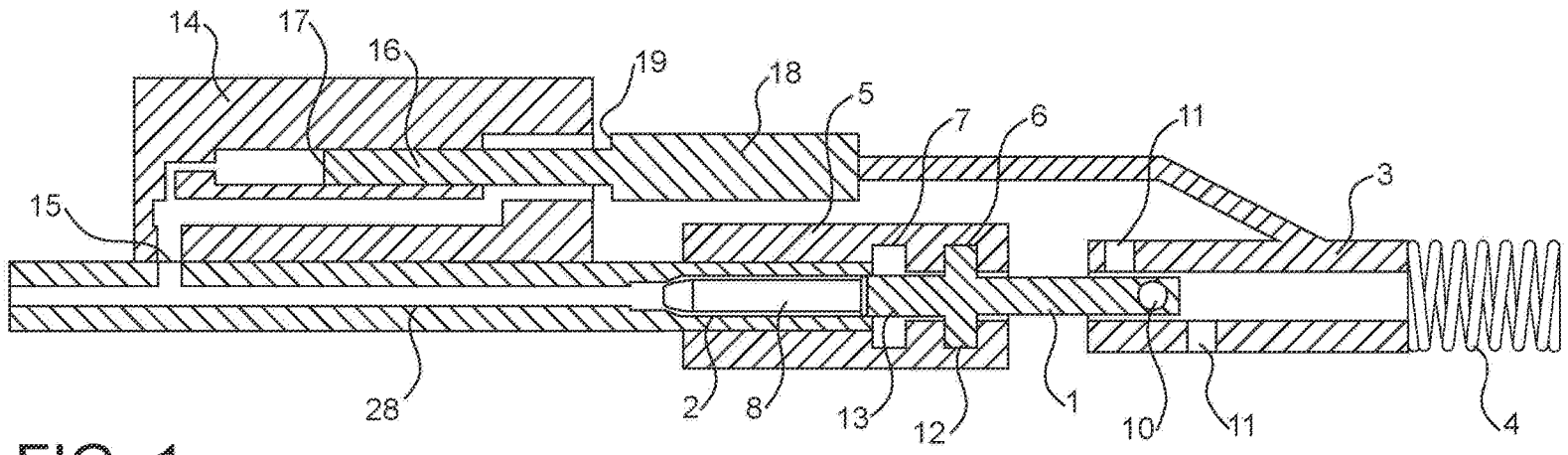
FIG. 1*a* depicts the multi-caliber self-loading action assembly with the large caliber round inserted.
Figure 1B:
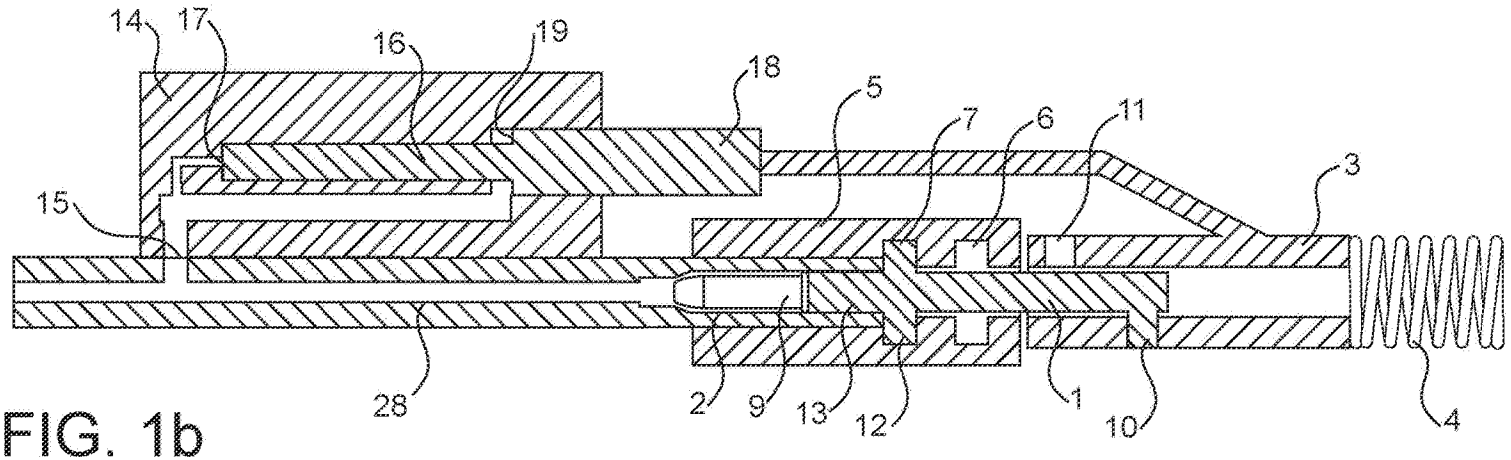
FIG. 1*b* depicts the multi-caliber self-loading action assembly with the small caliber round inserted.

In FIG. 1*a* and FIG. 1*b*, a non-limiting embodiment of the multi-caliber self-loading action assembly is shown. This embodiment shows two locked positions that can be used with two different caliber rounds. In the illustrated embodiment, the large caliber round 8 is characterized by a longer length than the small caliber round 9. In the illustrated embodiment, the large caliber round 8 and the small caliber round 9 have the same bullet diameter. When the large caliber round 8 is used, the bolt 1 is locked into the large caliber locked position 6, as shown in FIG. 1*a*. When the bolt 1 is in the large caliber locked position 6, the chamber stem 13 of the bolt 1 does not enter the chamber 2. The bolt 1 may be locked in into either the large caliber locked position 6 or the small caliber locked position 7 in order to accommodate the differing lengths of the large caliber round 8 and the small caliber round 9, respectively. When the small caliber round 9 is used, the bolt 1 is locked into the small caliber round locked position 7, as shown in FIG. 1*b*. When the bolt 1 is in the small caliber locked position 7, the chamber stem 13 of the bolt 1 enters the chamber 2. When the bolt 1 is pushed through the barrel extension 5, because of the rotational force applied to it, it is then locked into place. In this embodiment the lock 12 is in the form of a locking lug and is found on the bolt 1. The lock receiver is the channel on the barrel extension 5 that forms the large caliber locked position 6 and small caliber locked position 7 (seen clearer in FIG. 2). The rotational force is achieved through the use of a cam system, in the form of a cam pin 10 and cam channel 11, in this embodiment. In the cross sectional view the cam channel 11 appears as holes. The force to push the bolt 1 through the barrel extension 5 is due to the spring 4. A coaxial piston is then shown being used in the gas block 14 in this embodiment. The coaxial piston is comprised of the large caliber piston 16, the large caliber piston cup 17, the small caliber piston 18, and the small caliber piston cup 19. When the firearm is discharged, the gas will travel from the barrel 28 through the gas port 15 into the gas block 14 and then act on the coaxial piston. The coaxial piston will act on the bolt carrier 3, causing the spent casing of the round to be ejected, and a new round to be loaded into the firearm.

Figure 2:
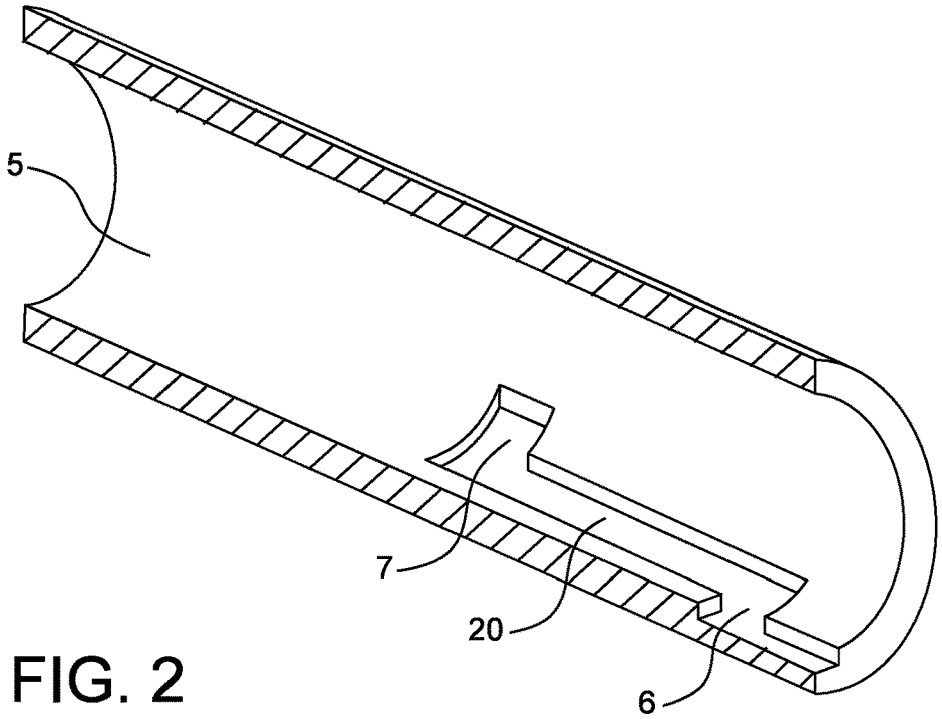
FIG. 2 depicts the lock receiver implemented onto a barrel extension.

In FIG. 2, a non-limiting embodiment of the lock receiver 20 is shown. In this embodiment, the lock receiver 20 is in the form of a locking channel and is found on the barrel extension 5. The large caliber locked position 6 and the small caliber locked position 7 are shown in the locking channel.

Figure 3A:
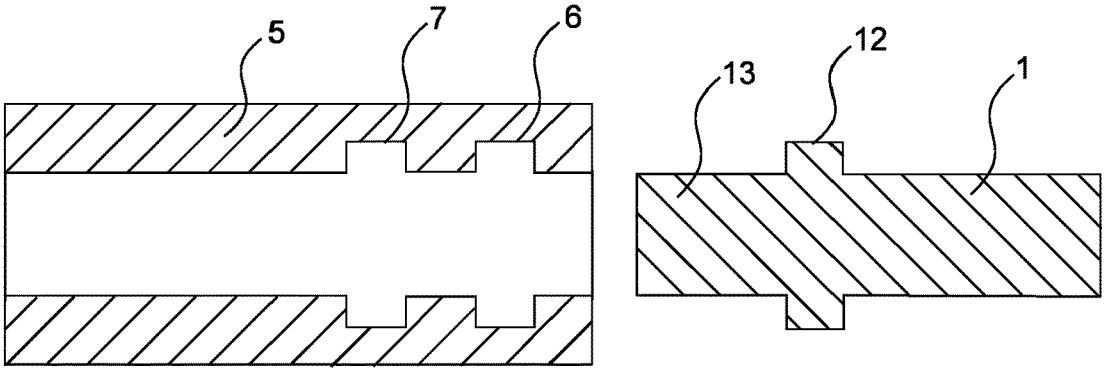
FIG. 3*a* depicts the lock on the bolt and the lock receiver on the barrel extension.

In FIG. 3*a*, a non-limiting embodiment of the multi-position locking assembly is shown. In this embodiment the lock 12 is on the bolt 1, and the lock receiver (seen clearer in FIG. 2) is on the barrel extension 5. The lock 12 is in the form of locking lugs in this embodiment. The bolt 1 can interface with the barrel extension 5 into two locked positions: the large caliber locked position 6 and small caliber locked position 7. The chamber stem 13 is shown on the bolt 1.

Figure 3B:
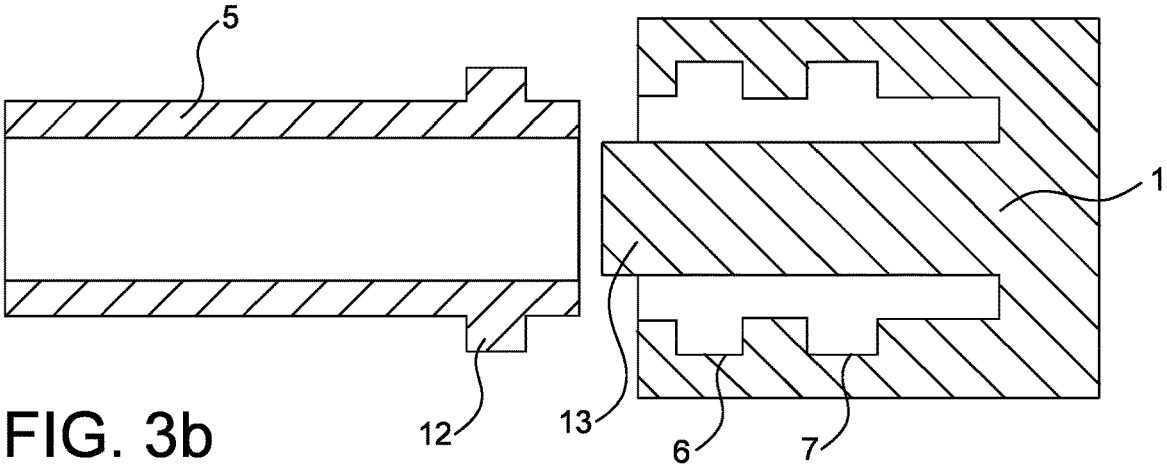
FIG. 3*b* depicts the lock on the barrel extension and the lock receiver on the bolt.

In FIG. 3*b*, a non-limiting embodiment of the multi-position locking assembly is shown. In this embodiment the lock 12 is on the barrel extension 5, and the lock receiver (seen clearer in FIG. 2) is on the bolt 1. The lock 12 is in the form of locking lugs in this embodiment. The bolt 1 can interface with the barrel extension 5 into two locked positions: the large caliber locked position 6 and small caliber locked position 7. The chamber stem 13 is shown on the bolt 1.

In these configurations as shown in FIG. 3*a* and FIG. 3*b*, the bolt carrier (not shown) could either be situated behind the bolt 1 and push the bolt into position; or the bolt carrier could be in front of the bolt and pull the bolt into position (not shown).

Figure 4A:
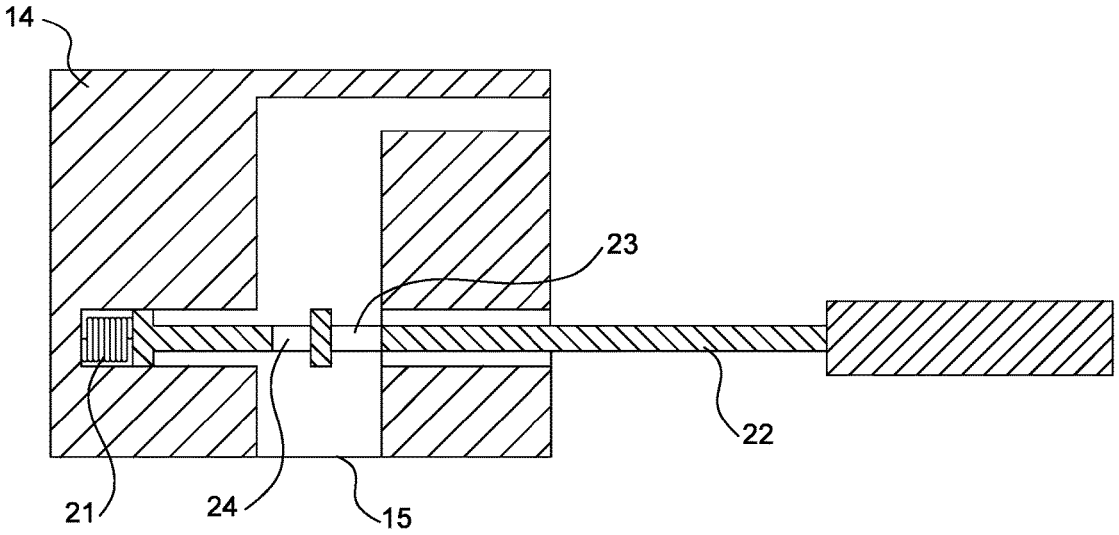
FIG. 4*a* depicts the self-regulating gas assembly in the sliding plate embodiment in the configuration with the small caliber round inserted.
Figure 4B:
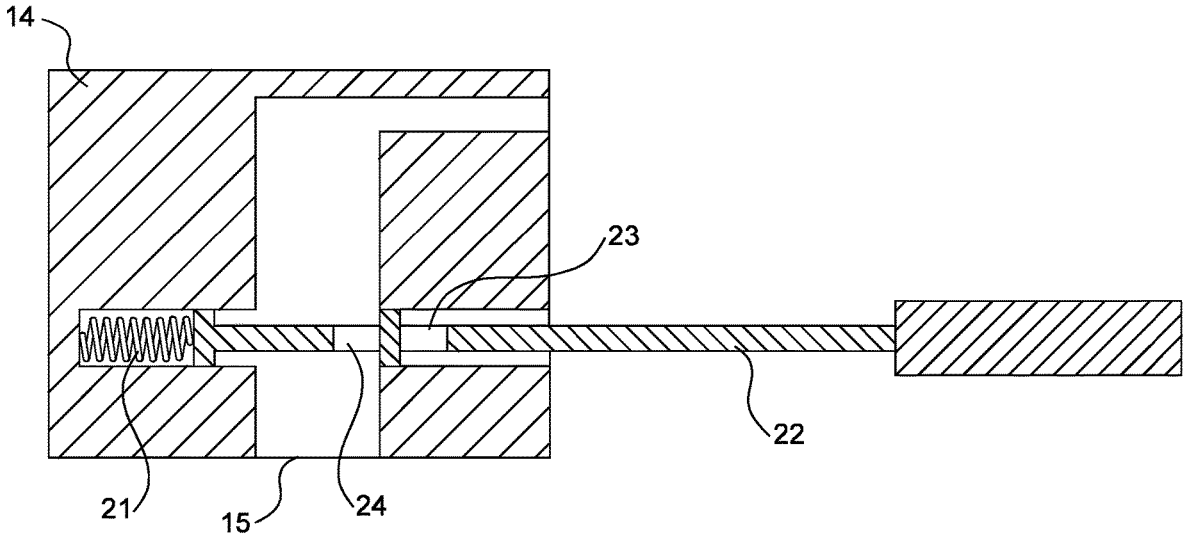
FIG. 4*b* depicts the self-regulating gas assembly in the sliding plate embodiment in the configuration with the large caliber round inserted.

In FIG. 4*a* and FIG. 4*b*, a non-limiting embodiment of the self-regulating gas assembly is shown. In this embodiment, the gas regulation occurs through a sliding plate 22, but can also be accomplished through another blocking body (not shown). The sliding plate's 22 position moves through the gas block 14, where the sliding plate's 22 multiple positions are based on the position of the multi-position locking assembly, which is based on the caliber of the round used (not shown). In FIG. 4*a*, the sliding plate 22 is in the small caliber position, such that the gas can pass through both the small caliber aperture 23 and the large caliber aperture 24. In FIG. 4*b*, the sliding piston 22 is in the large caliber position, such that the gas can only pass through the large caliber aperture 24. In this embodiment, gas flows from the barrel (not shown) through the gas port 15 into the gas block 14 after the firearm is discharged. In this embodiment, the sliding plate spring 21 acts on the sliding plate 22 to keep the sliding plate in the correct position, based on what caliber round is inserted into the firearm. When the larger caliber (not shown) is inserted, the aperture that allows the gas to pass through to the action (which could be but not limited to a direct impingement, short stroke piston, or long stroke system) is smaller than when the small caliber round is inserted. This is because the smaller caliber produces less gas when discharged, so more gas will need to be let through to actuate the multi-position locking assembly, so that the spent casing can successfully be ejected, and a new round can be loaded into the firearm. This is also why the aperture is smaller when the larger caliber round is inserted, as there is a lot more gas that is generated from the discharge, so the aperture should be smaller. Both aperture sizes will be configured so that the force from the gas is optimal for that specific caliber in use, as excessive or insufficient force can cause malfunctions when the firearm is cycled.

Figure 5A:
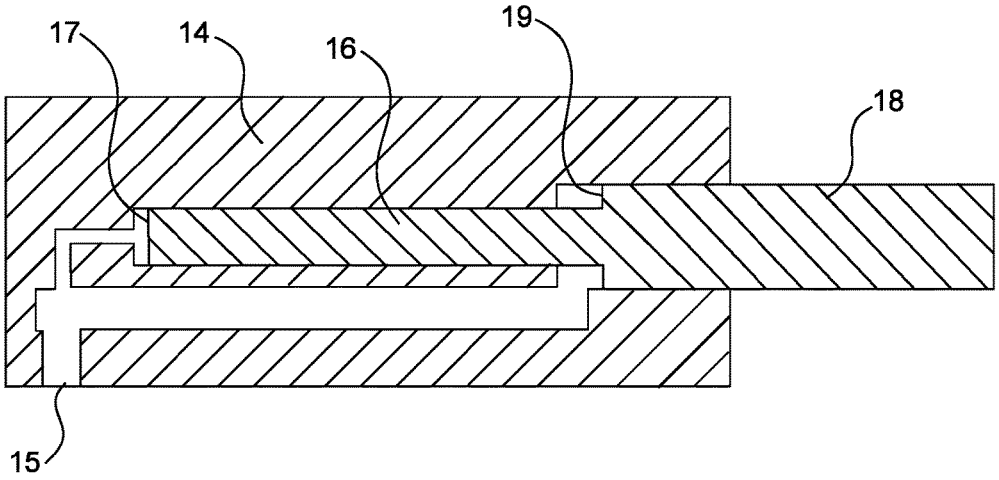
FIG. 5*a* depicts the self-regulating gas assembly in the coaxial piston embodiment in the configuration with the small caliber round inserted.
Figure 5B:
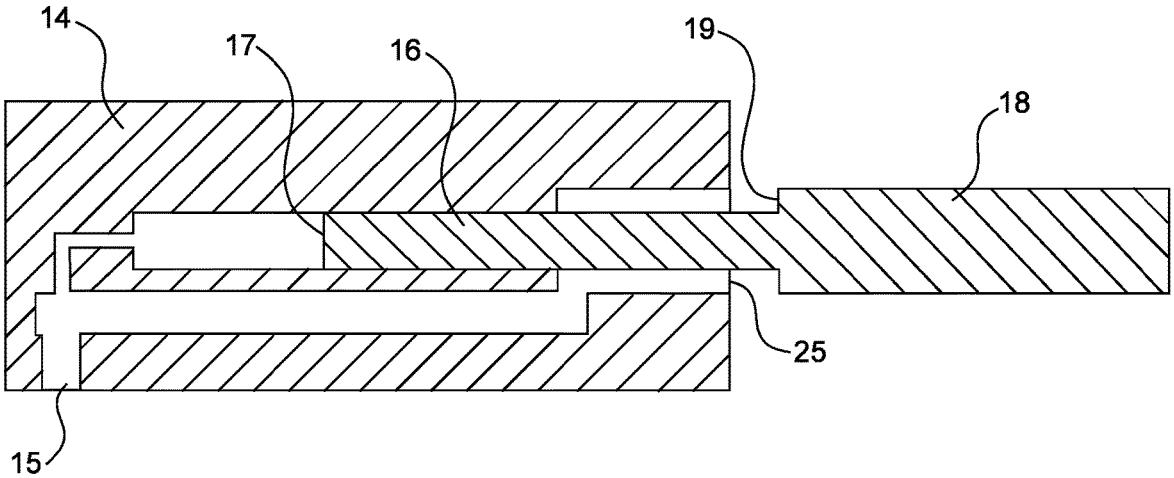
FIG. 5*b* depicts the self-regulating gas assembly in the coaxial piston embodiment in the configuration with the large caliber round inserted.

In FIG. 5*a* and FIG. 5*b*, a non-limiting embodiment of the self-regulating gas assembly is shown. In this embodiment, there are two coaxial, pistons, and two piston cups. The coaxial pistons and piston cups correspond to two different caliber rounds. In FIG. 5*a*, the small caliber round is inserted into the firearm (not shown) and both pistons are engaged. In FIG. 5*a*, the large caliber piston 16 and thus large caliber piston cup 17 is engaged; as well as the small caliber piston 18 and thus the small caliber piston cup 19. In FIG. 5*b*, the large caliber round is inserted into the firearm (not shown). In FIG. 5*b* only the large caliber piston 16 and thus large caliber piston cup 17 is engaged. In this embodiment, gas flows from the barrel (not shown) through the gas port 15 into the gas block 14 after the firearm is discharged. As compared to FIG. 5*a* where both pistons need to be engaged due to the small amount of gas generated by the small caliber round, in FIG. 5*b*, only one piston is engaged as the larger caliber round generates more gas. Excess gas is vented from the system when the large caliber round is inserted, as shown in the excess gas vent 25 in FIG. 5*b*. The reduction in piston and piston cup engagement counterbalances the increase in gas generation, thus resulting in a similar force when the action is cycled. The pistons in this system then interface with the bolt carrier (not shown) and push that back when the firearm is discharged. The piston cup sizes will be configured so that an appropriate force is distributed to the bolt carrier so that the spent casing can successfully be ejected, and a new round loaded into the firearm.

Figure 6A:
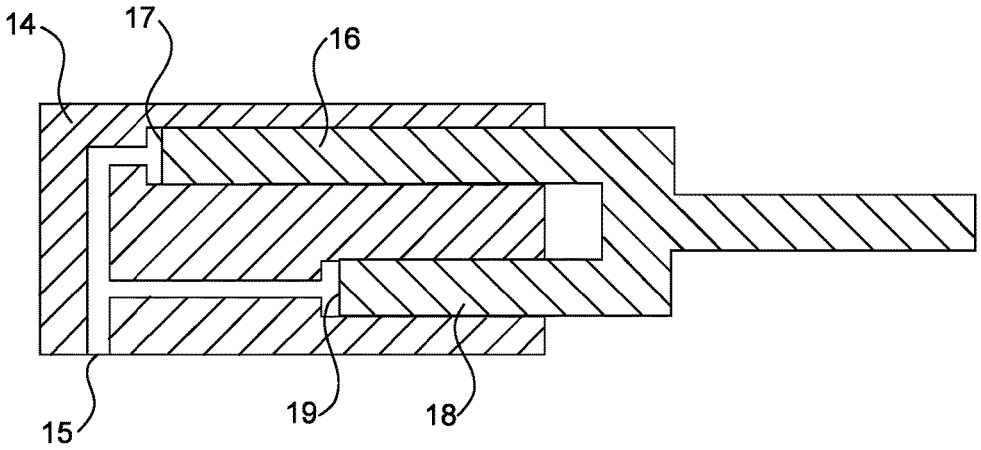
FIG. 6*a* depicts the self-regulating gas assembly in the dual piston embodiment in the configuration with the small caliber round inserted.
Figure 6B:
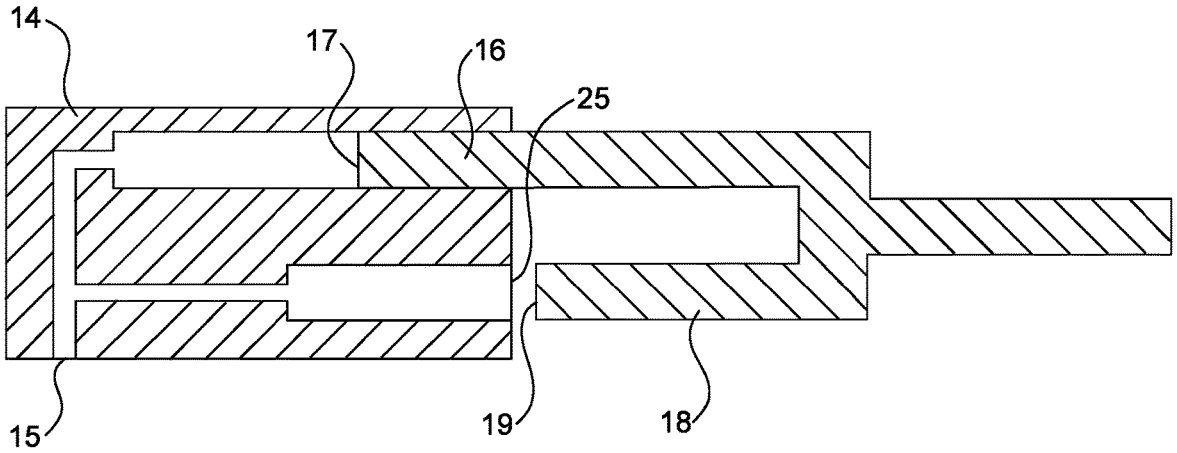
FIG. 6*b* depicts the self-regulating gas assembly in the dual piston embodiment in the configuration with the large caliber round inserted.

In FIG. 6*a* and FIG. 6*b*, a non-limiting embodiment of the self-regulating gas assembly is shown. This is the same premise as shown in FIG. 5*a* and FIG. 5*b*, except that FIG. 6*a* and FIG. 6*b* use two separate pistons instead of a coaxial piston. In this embodiment, there is a long piston and a short piston. For this embodiment, the long piston should be regarded as the large caliber piston 16 and the short piston regarded as the small caliber piston 18. In FIG. 6*a*, the small caliber round is inserted into the firearm (not shown) and both pistons are engaged. In FIG. 6*a*, the large caliber piston 16 and thus large caliber piston cup 17 is engaged; as well as the small caliber piston 18 and thus the small caliber piston cup 19. In FIG. 6*b*, the large caliber round is inserted into the firearm (not shown). In FIG. 6*b*, only the large caliber piston 16 and thus large caliber piston cup 17 is engaged. In this embodiment, gas flows from the barrel (not shown) through the gas port 15 into the gas block 14 after the firearm is discharged. As compared to FIG. 6*a* where both pistons need to be engaged due to the small amount of gas generated by the small caliber round, in FIG. 6*b*, only one piston is engaged as the larger caliber round generates more gas. Excess gas is vented from the system when the large caliber round is inserted, as shown in the excess gas vent 25 in FIG. 6*b*. The reduction in piston and piston cup engagement counterbalances the increase in gas generation, thus resulting in a similar force when the action is cycled. The pistons in this system then interface with the bolt carrier (not shown) and push that back when the firearm is discharged. The piston cup sizes will be configured so that an appropriate force is distributed to the bolt carrier so that the spent casing can successfully be ejected, and a new round loaded into the firearm.

Figure 7A:
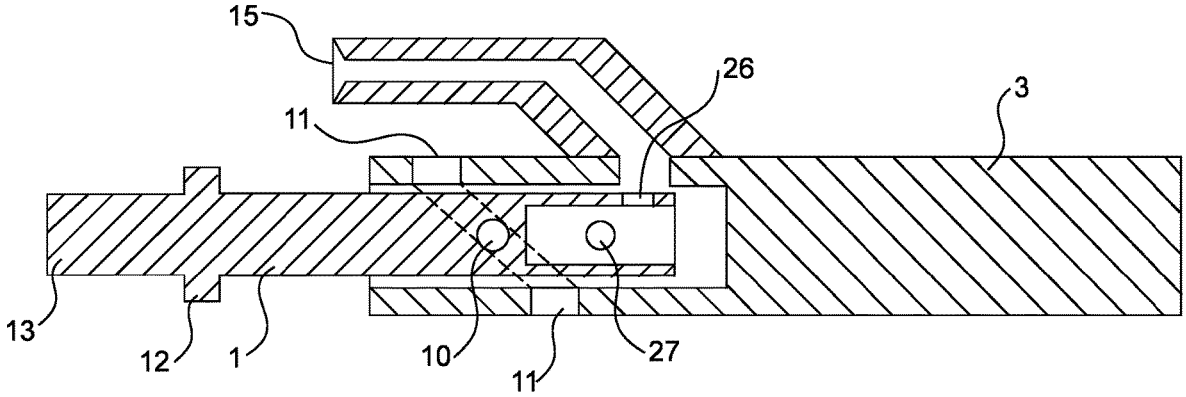
FIG. 7*a* depicts the multi-caliber self-loading action assembly in the embodiment with the gas regulation occurring in the bolt in the configuration with the small caliber round inserted.
Figure 7B:
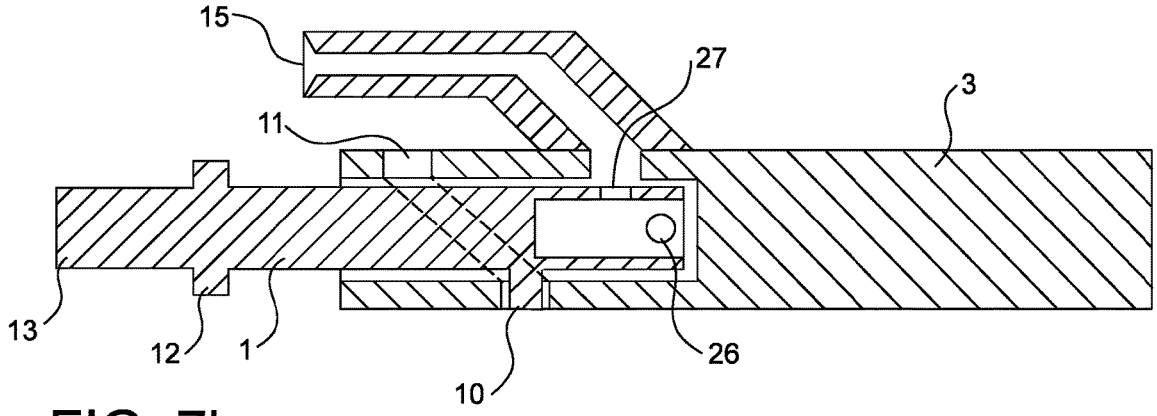
FIG. 7*b* depicts the multi-caliber self-loading action assembly in the embodiment with the gas regulation occurring in the bolt in the configuration with the large caliber round inserted.

In FIG. 7*a* and FIG. 7*b*, a non-limiting embodiment of the multi-caliber self-loading action assembly is shown. This embodiment depicts the multi-position locking assembly as in FIG. 1*a* and FIG. 1*b*, with the gas regulation taking place within the bolt 1 instead of the gas block (not shown). In this embodiment, the two different caliber rounds result in two different locked positions, with the bolt 1 rotating through the bolt carrier 3 utilizing the cam system of the cam pin 10 and the cam channel 11. In the cross sectional view the cam channel 11 appears as holes. The bolt 1 also has a gas regulator component. In this embodiment, gas is received from the gas block (not shown) unregulated, through the gas port 15. There are different intake ports on the bolt 1, where the intake port's position is based on the rotated position of the bolt 1. If the larger caliber is inserted into the firearm, the bolt will be configured to intake more of the gas than when the small caliber round is inserted. This will be configured with different sized intake ports that will be rotated in position based on the locked position of the bolt. FIG. 7*a* depicts the multi-caliber self-loading action assembly with the small caliber inserted into the firearm (not shown). The small caliber intake 26 is rotated to receive the gas from the gas port 15 in this configuration. FIG. 7*b* depicts the multi-caliber self-loading action assembly with the large caliber inserted into the firearm (not shown). The large caliber intake is rotated to receive the gas from the gas port 15 in this configuration. In this configuration, the gas that was taken into the system causes the firearm to cycle utilizing the same manner as an AR-15 rifle.

I claim:

1. A self-regulating gas assembly for a firearm, the self-regulating gas assembly comprising:

a gas block configured to interface with a gas port on a first end of a barrel of the firearm; and at least one piston having a piston face on a first end thereof, the first end located in the gas assembly with the piston face positioned to receive gas via at least one gas conduit from the gas port of the gas block; and a barrel extension positioned at a second end of the barrel opposite the first end; and a bolt carrier assembly including a bolt and a bolt carrier;

wherein the barrel extension has a first slot and a second slot into which a lock lug of the bolt interfaces to engage the bolt into a first locked position and a second locked position, respectfully, wherein the firearm is configured to be discharged when the lock lug is in each of the first locked position and the second locked position, wherein the barrel extension engages a second end of the barrel opposite the first end;

wherein the bolt carrier houses a second end of the piston at a second end opposite the first end;

wherein the bolt includes the lock lug that slides within the barrel extension along a lock channel into/between the first locked position and the second locked position.

2. The self-regulating gas assembly of claim 1, wherein the gas block is further configured to regulate an amount of gas, wherein the regulation of the amount of gas depends on when a discharge of the firearm occurs.

3. The self-regulating gas assembly of claim 1, wherein the gas block is further configured to direct the amount of gas to the at least one piston face.

4. The self-regulating gas assembly of claim 3, wherein a portion of the amount of gas is vented.

5. The self-regulating gas assembly of claim 4, wherein a remaining gas is dependent on the amount of gas vented during the discharge of the firearm.

6. The self-regulating gas assembly of claim 4, wherein the at least one piston face is further configured to act on the at least one piston through the remaining gas.

7. The self-regulating gas assembly of claim 1, wherein the at least one piston is further configured to have a starting position, wherein the starting position of the at least one piston is determined by a length of a caliber inserted into the firearm.

8. The self-regulating gas assembly of claim 7, wherein the gas block is further configured to direct the amount of gas to the at least one piston face.

9. The self-regulating gas assembly of claim 8, wherein a remaining gas is dependent on the amount of gas vented during the discharge of the firearm.

10. The self-regulating gas assembly of claim 4, wherein a remaining gas is dependent on the amount of gas vented during the discharge of the firearm, and wherein the piston face is convex.

11. The self-regulating gas assembly of claim 4, wherein the at least one piston face is further configured to act on the at least one piston through the remaining gas.

12. The self-regulating gas assembly of claim 2, wherein the gas block is further configured to direct the amount of gas to the at least one piston face.

13. The self-regulating gas assembly of claim 4, wherein the piston face is convex.

14. The self-regulating gas assembly of claim 12, wherein a portion of the amount of gas is vented.

15. The self-regulating gas assembly of claim 14, wherein a remaining gas is dependent on the amount of gas vented during the discharge of the firearm.

16. The self-regulating gas assembly of claim 14, wherein the at least one piston face is further configured to act on the at least one piston through the remaining gas.

17. The self-regulating gas assembly of claim 14, wherein a remaining gas is dependent on the amount of gas vented during the discharge of the firearm.

18. The self-regulating gas assembly of claim 14, wherein the piston face is convex.

19. The self-regulating gas assembly of claim 14, wherein the at least one piston face is further configured to act on the at least one piston through the remaining gas.

20. The self-regulating gas assembly of claim 19, wherein a portion of the amount of gas is vented.

* * * * *